US006269842B1

(12) United States Patent
Chuang

(10) Patent No.: US 6,269,842 B1
(45) Date of Patent: Aug. 7, 2001

(54) WEAVING LOOM WITH CIRCULATING MAGNETIC SHUTTLE

(75) Inventor: Wu-Chen Chuang, Tainan (TW)

(73) Assignee: Cheng-Hsiung Cheng, Taipei Hsien (TW)

( * ) Notice: Subject to any disclaimer, the term of this patent is extended or adjusted under 35 U.S.C. 154(b) by 0 days.

(21) Appl. No.: 09/769,195

(22) Filed: Jan. 24, 2001

(51) Int. Cl.[7] ..... D03D 49/44; D03D 47/27; D03D 47/24

(52) U.S. Cl. ..... 139/134; 139/192

(58) Field of Search ..... 139/134, 192

(56) References Cited

U.S. PATENT DOCUMENTS 4,762,153 * 8/1988 Chuang et al. ..... 139/134

FOREIGN PATENT DOCUMENTS

2211491 * 3/1972 (DE) .
1074646 * 7/1999 (EP) .
2128661 * 10/1972 (FR) .

* cited by examiner

*Primary Examiner*—Andy Falik
(74) *Attorney, Agent, or Firm*—Ladas & Parry

(57) ABSTRACT

A weaving loom has a transmission, which includes a driving wheel, a driven wheel, an endless driving belt that extends around the driving wheel and the driven wheel, and at least one magnet unit, which is secured to an inside surface of the belt for attracting and driving a shuttle to circulate on a machine frame inside the belt.

8 Claims, 7 Drawing Sheets

WEAVING LOOM WITH CIRCULATING MAGNETIC SHUTTLE

BACKGROUND OF THE INVENTION

1. Field of the Invention

This invention relates to a weaving loom, more particular to a weaving loom, which is provided with a circulating magnetic shuttle that circulates along an endless loop.

2. Description of the Related Art

In a conventional weaving loom, a reciprocating shuttle reciprocates along a straight race rail. When in a picking motion, the flying speed of the reciprocating shuttle is accelerated from 0 to a high constant speed, and is then braked and decelerated to 0. Subsequently, the same picking motion is repeated in the opposite direction, thereby increasing largely the weft picking time.

To overcome the time-consuming problem, the applicant heretofore proposed an improved weaving loom, which is provided with a circulating magnetic shuttle. Referring to FIG. 1, the improved weaving loom 1 is shown to include a driving wheel 111 that drives a driving belt 113 to circulate. A series of magnets 114 is secured to the belt 113 for attracting and driving a magnetic shuttle 13 to circulate along an endless loop. The shuttle 13 picks a weft with the assistance of a weft swinging rod 16, and then moves the weft over a reed assembly 20, which is held on a swing arm 221 that is fixed on a rotating shaft 222. When the rotating shaft 222 rotates, the reed assembly 20 beats the weft 16. Two series of guiding rollers 12 are disposed respectively around a driving wheel 111 and a driven wheel 112 so that, when moving along two curved portions of a race rail 101, the shuttle 13 does not take off and deviate from the race rail 101 because of the centrifugal force that is generated. The conventional weaving loom 1 suffers from the following disadvantages:

1. The structure of the weaving loom 1 is relatively complicated. For example, a relatively long race rail 101 is needed to be disposed around the driving belt 113, thereby serving as a passage of the shuttle 13. In addition, a large number of guiding rollers 12 are disposed around the driving wheel 111 and the driven wheel 112 so as to guide the shuttle 13 to move along a curved path, thereby preventing the deviation of the shuttle 13 from an endless loop. As a result, it is difficult to manufacture the weaving loom 1, thereby increasing the manufacturing costs.

2. The shuttle 13 cannot move smoothly on the race rail 101. Ideally, the portion of the belt 113 between the driving wheel 111 and the driven wheel 112 should be in a horizontal position. However, during the movement of the magnets 114 between the driving wheel 111 and the driven wheel 112, the portion of the belt 113, to which the magnets 114 are attached, is slightly lower than the remaining portion of the belt 113, which is located between the driving wheel 111 and the driven wheel 112 due to the weight of the magnets 114. The larger the distance between the wheels 111, 112, the more serious the deviation of the magnets 114 from their predetermined circulating path. It is unavoidable, when weaving wider fabrics, to increase the distance between the wheels 111, 112. As a result, the belt 113 and magnets 114 cannot circulate smoothly at a high speed. Furthermore, because the shuttle 13 moves on the race rail 101, and contacts frequently the guiding rollers 12, it cannot fly smoothly along the endless loop, thereby reducing the weaving efficiency.

3. It is difficult to maintain and repair the weaving loom 1. To descend the gravity center of the weaving loom 1 and reduce the vibration of the same, the race rail 101 and the guiding rollers 12 are disposed on a lower portion of the weaving loom 1 along with the swinging arm 221 and the rotating shaft 222. Because they are disposed relatively close to each other, it is difficult to maintain and repair the weaving loom 1.

SUMMARY OF THE INVENTION

The object of this invention is to provide an improved weaving loom, which is provided with a circulating magnetic shuttle and which has a simple structure that can be easily maintained and repaired and that can be operated smoothly, thereby increasing the weaving efficiency.

According to this invention, a weaving loom includes a transmission. The transmission includes a driving wheel, a driven wheel, an endless driving belt that extends around the driving wheel and the driven wheel, and at least one magnet unit, which is secured to an inside surface of the belt for attracting and driving a shuttle to circulate on a machine frame inside the belt.

BRIEF DESCRIPTION OF THE DRAWINGS

Other features and advantages of the invention will become apparent in the following detailed description of the preferred embodiments with reference to the accompanying drawing, in which.

DETAILED DESCRIPTION OF THE PREFERRED EMBODIMENTS

Figure 1:
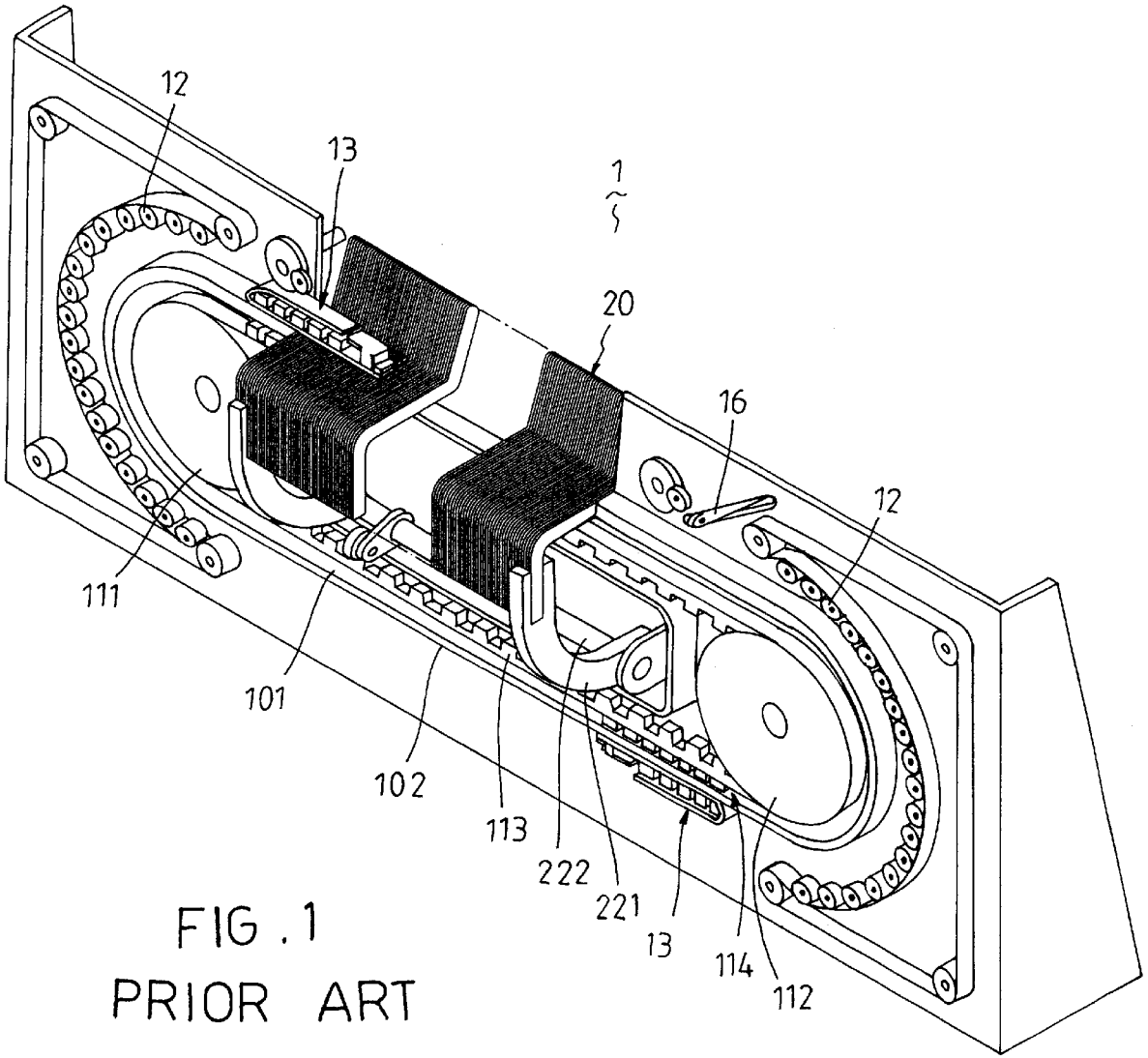
FIG. 1 PRIOR ART
FIG. 1 is a perspective view of a conventional weaving loom.
Figure 2:
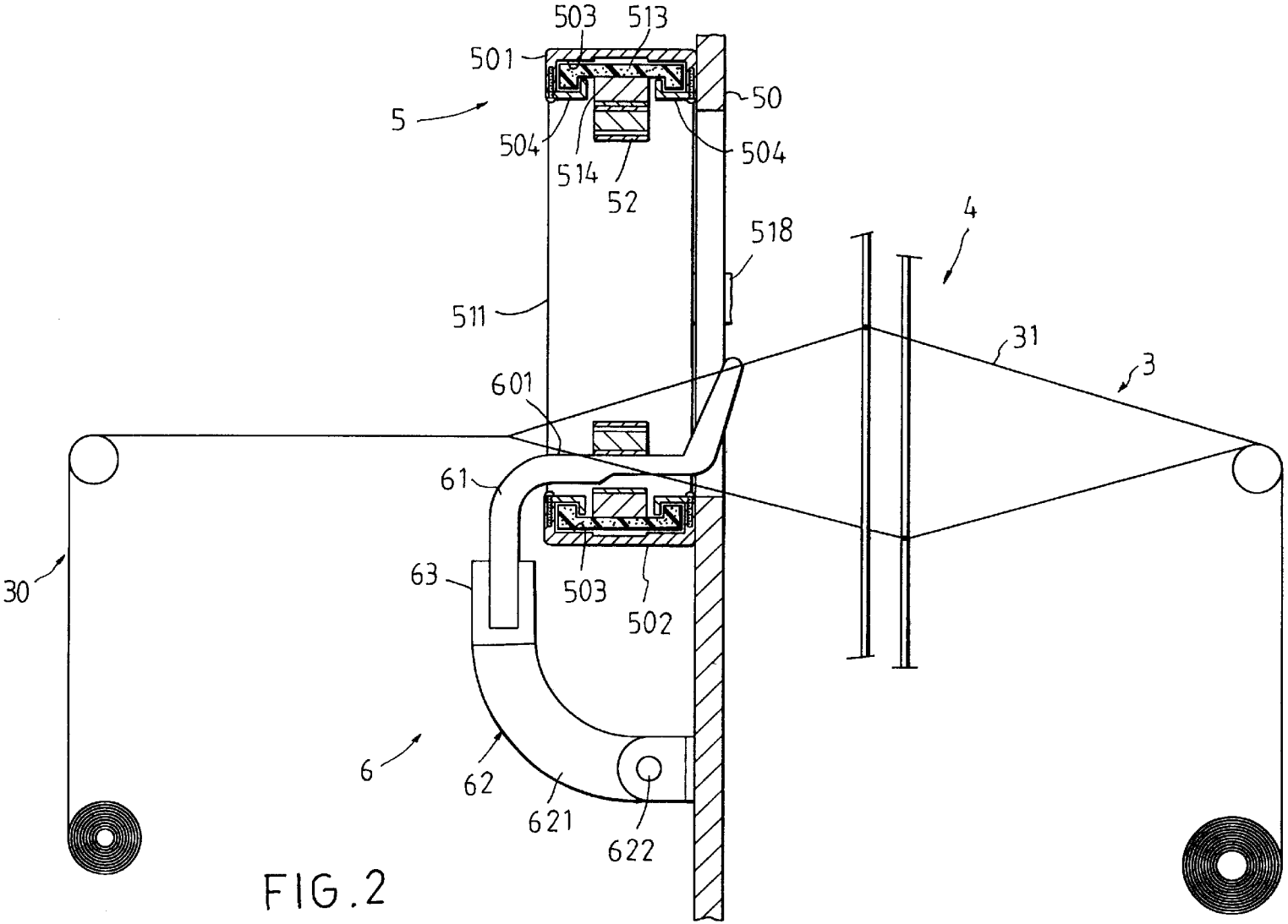
FIG. 2 is a schematic side view of a first preferred embodiment of a weaving loom according to this invention.

Referring to FIG. 2, a first preferred embodiment of a weaving loom according to this invention is shown to include a warp supplying mechanism 3 for feeding warps 31, a shedding mechanism 4 for forming a shed between the warps 31, a weft picking mechanism 5 for picking a weft into the shed, a weft beating mechanism 6 for beating the picked weft into a fell in the shed, and a fabric collecting mechanism 30.

Figure 3:
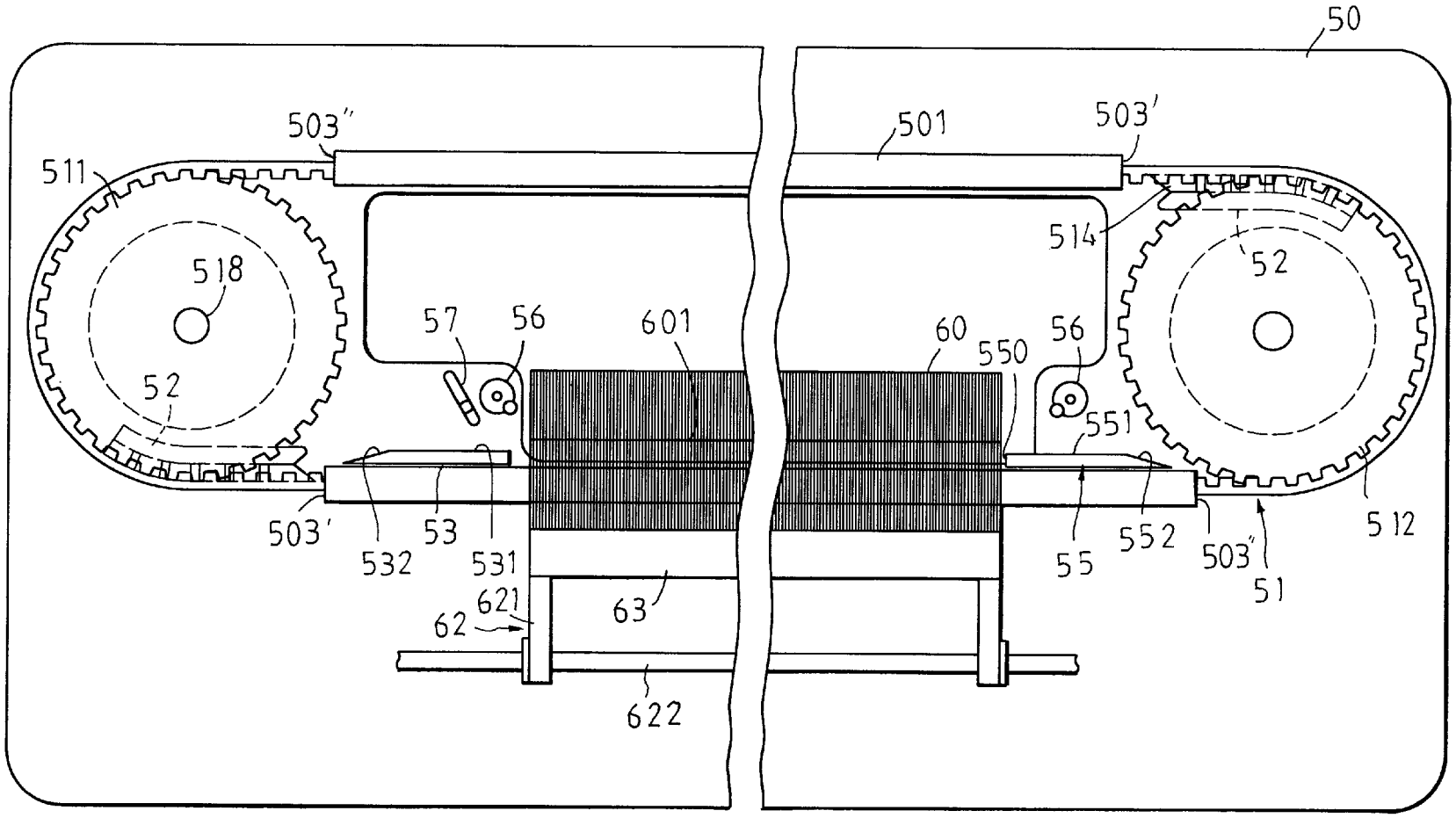
FIG. 3 is a schematic front view of the preferred embodiment.

Referring to FIGS. 2 and 3, the picking mechanism 5 includes a machine frame 50, a circulating transmission 51 disposed on the machine frame 50, and two magnetic shuttles 52 driven by the transmission 51. The transmission 51 includes a driving wheel 511 disposed rotatably on the machine frame 50, a driven wheel 512 disposed rotatably on the machine frame 50, an endless driving belt 513 extending around the driving wheel 511 and the driven wheel 512 and driven by the driving wheel 511 to circulate, and two magnet units 514, which are secured to an inside surface of the driving belt 513 for attracting and driving the shuttles 52 to circulate on the machine frame 50.

The structures and operations of the transmission 51 and one of the shuttles 52 are described in the succeeding paragraphs.

The frame 50 includes a fixed upper race rail 501 and a fixed lower race rail 502. Each of a bottom surface of the upper race rail 501 and a top surface of the lower race rail 502 is formed with an open-ended longitudinal guide slot 503, and two fixed anti-wear longitudinal plates 504, which extend respectively into two side portions of the guide slot 503 to locate the shuttle 52 between one of the upper and lower race rails 501, 502 and the longitudinal plates 504, thereby confining the shuttle 52 within the guide slot 503. The shuttle 52 is attracted onto the magnet unit 514 during the movement of the shuttle 52 within the upper and lower race rails 501, 502.

Each of the guide slots 503 of the upper and lower race rails 501, 502 has a shuttle inlet 503', through which the shuttle 52 moves into the guide slot 503, and a shuttle outlet 503", from which the shuttle 52 leaves the longitudinal guide slot 503.

Figure 4:
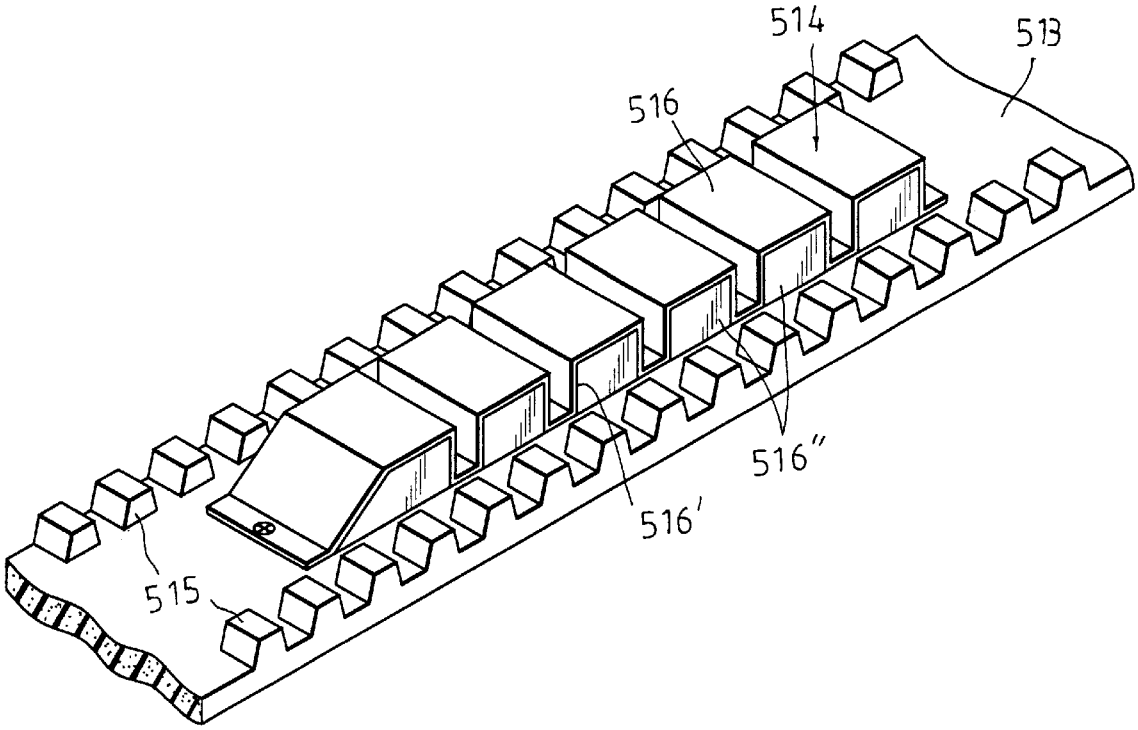
FIG. 4 is a fragmentary perspective view of a driving belt of the first preferred embodiment.

Referring to FIG. 4, the inside surface of the driving belt 513 is formed with two longitudinal rows of teeth 515, between which the magnet units 513 (only one is shown) are disposed. Each of the magnet units 514 includes an elongated and corrugated longitudinal plate 516, which is fixed on the driving belt 513 so as to define a plurality of magnet receiving spaces 516' between the longitudinal plate 516 and the driving belt 513, thereby receiving a plurality of magnets 516" fittingly therein.

Figure 5:
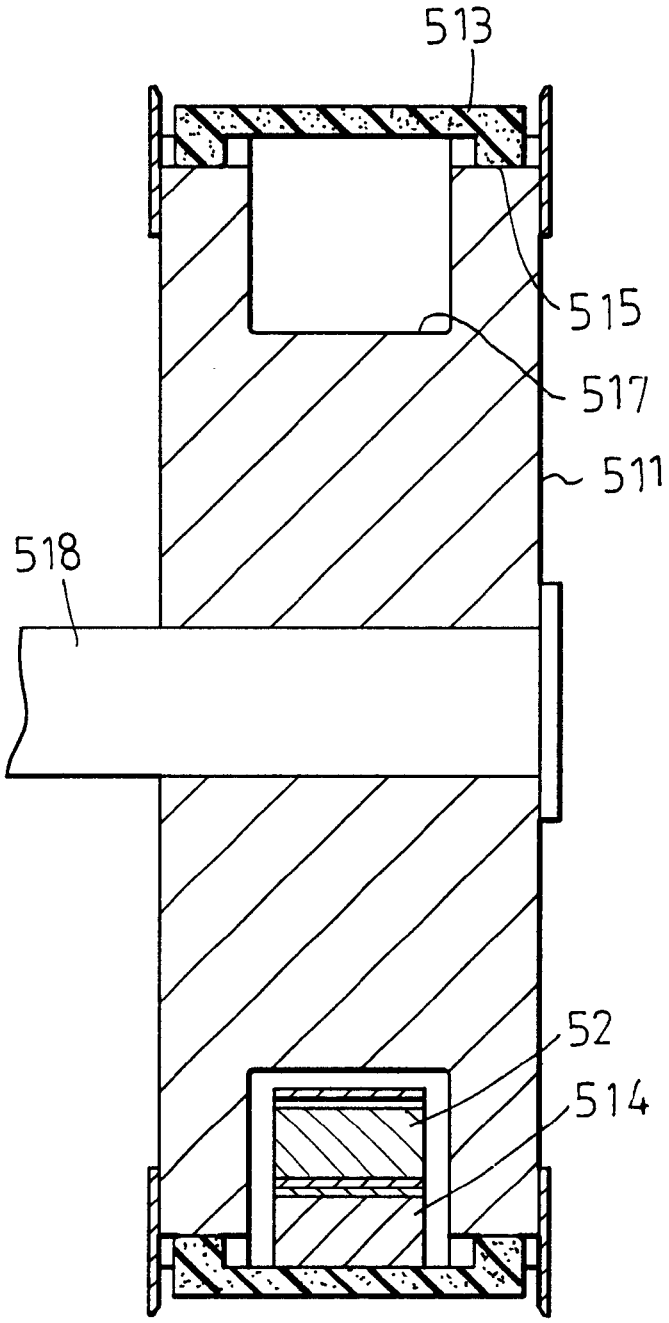
FIG. 5 is a schematic sectional view of a driving wheel of the first preferred embodiment.

The driving wheel 511 and the driven wheel 512 have the same structure. Referring to FIG. 5, the driving wheel 511 is constructed as a spur gear, which has an outer periphery that is formed with teeth for engaging the teeth 515 of the driving belt 513. The driving wheel 511 has a rim that is formed with an annular groove 517, within which the magnet unit 514 and the shuttle 52 move in such a manner that the shuttle 52 is attracted onto the magnet unit 514. The driving wheel 511 is sleeved fixedly on a rotating shaft 518.

Referring to FIGS. 2 and 3, the beating mechanism 6 includes a reed assembly 60 consisting of a row of reed dents 61, and a swinging device 62. The reed dents 61 are disposed on a sley 63. The swinging device 62 is connected fixedly to the reed assembly 60 for swinging the same, and includes a swinging arm 621 and a rotating shaft 622, which are interconnected fixedly. Each of the reed dents 61 has a horizontal portion so as to form a flat shuttle guide-way 601 thereon, thereby guiding the shuttle 52 into the shed. The machine frame 50 is provided with an elongated wedge-shaped divider 53 and an elongated wedge-shaped jointer 55, which are disposed fixedly on two sides of the reed assembly 60. The divider 53 is adjacent to and is located between the driving wheel 511 and the shuttle inlet 503' of the guide slot 503 in the lower race rail 502, and has an abutment end that is adjacent to the shuttle guide-way 601, a flat horizontal top surface 531 that is flush with the shuttle guide-way 601, and a wedge-shaped end 532. As such, the shuttle 52 moves from the driving wheel 511 along the driving belt 513 to the wedge-shaped end 532 of the divider 53, thereby separating the shuttle 52 and the magnet unit 514 at the wedge-shaped end 532. Subsequently, the shuttle 52 moves from the wedge-shaped end 532 to the top surface 531 of the divider 53 and the shuttle guide-way 601 on the reed assembly 60. A left pressing roller 56 and a weft swinging rod 57 are mounted near the reed assembly 60 in a known manner. The jointer 55 is mounted between the reed assembly 60 and the driven wheel 512 in a manner similar to that of the divider 53, and has an abutment end 550, a flat horizontal top surface 551, and a wedge-shaped end 552. A right pressing roller 56 is disposed over the jointer 55 in a manner similar to that of the left pressing roller 56. The shuttle 52 leaves from the wedge-shaped end 552 of the jointer 55 to be again attracted onto the magnet unit 514.

Figure 6:
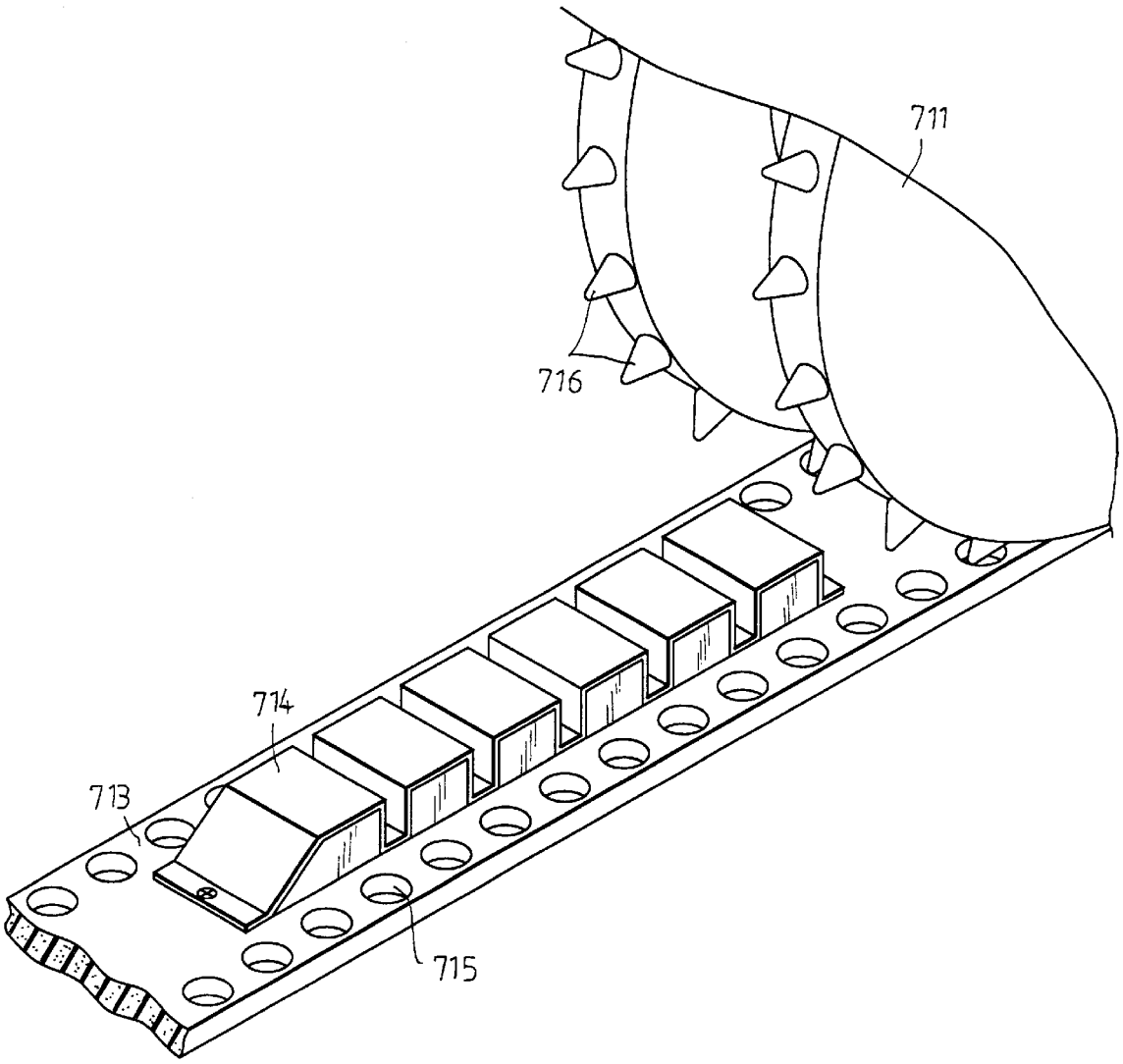
FIG. 6 is a perspective view illustrating the connection between a driving belt and a driving wheel of a second preferred embodiment of a weaving loom according to this invention.

Referring to FIG. 6, a modified transmission is shown to include a driving wheel 711, a driven wheel (not shown) that has the same structure as the driving wheel 711, and a driving belt 713. A magnet unit 714 is secured to the belt 713 in a manner similar to that of the previous embodiment, and is similar to that of the previous embodiment in construction. Two longitudinal rows of guide holes 715 are formed through the belt 713 on two sides of the magnet unit 714. The driving wheel 711 has an outer periphery, which is formed with a plurality of fixed short tongues 716 that extend radially and outwardly therefrom to engage the guide holes 715 in the belt 713.

Figure 7:
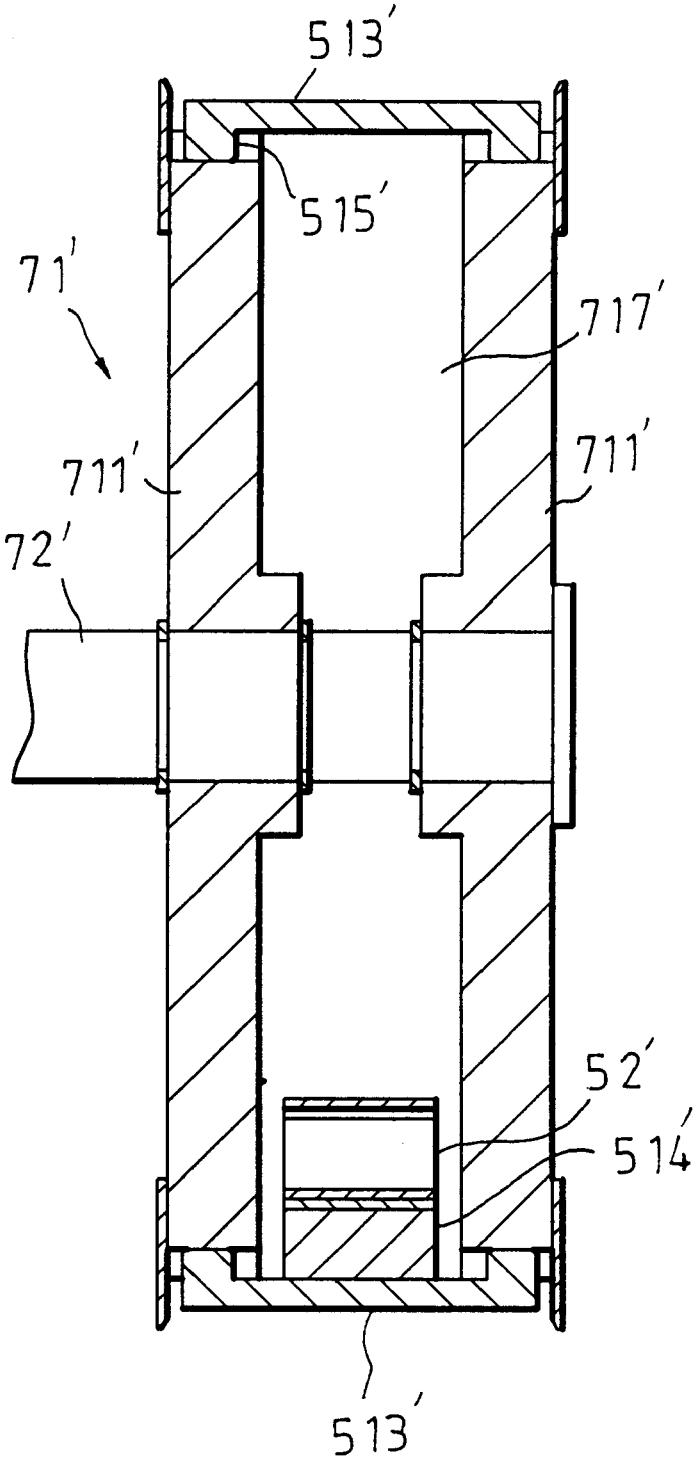
FIG. 7 is a schematic front view illustrating a modified driving wheel.

Referring to FIG. 7, a modified driving wheel 71' is shown to include two spur gears 711' that are sleeved fixedly on a rotating shaft 72' and that are spaced apart from each other, thereby defining therebetween a space 717', within which the shuttle 52' and the magnet unit 514' move. Each of the gears 711' has an outer periphery that is formed with teeth for engaging the teeth 515' of the driving belt 513.

With this invention thus explained, it is apparent that numerous modifications and variations can be made without departing from the scope and spirit of this invention. It is therefore intended that this invention be limited only as indicated by the appended claims.

I claim:

1. A weaving loom including a warp supplying mechanism for feeding warps, a shedding mechanism for forming a shed between said warps, a weft picking mechanism for picking a weft into said shed, and a weft beating mechanism for beating said weft into a fell in said shed, said picking mechanism including a machine frame, a circulating transmission disposed on said machine frame, and a shuttle driven by said transmission, said transmission including a driving wheel disposed rotatably on said machine frame, a driven wheel disposed rotatably on said machine frame, an endless driving belt extending around said driving wheel and said driven wheel and driven by said driving wheel to circulate, and at least one magnet unit secured to said driving belt for attracting and driving said shuttle to circulate on said machine frame, wherein the improvement comprises:

said driving belt having an outer side surface and an inside surface, said magnet unit being secured to said inside surface of said driving belt, said shuttle circulating on said machine frame inside said driving belt and being attracted onto said magnet unit during movement of said shuttle around said driving wheel and said driven wheel .

2. The weaving loom as claimed in claim 1, wherein each of said driving wheel and said driven wheel has a rim that is formed with an annular groove, within which said shuttle and said magnet unit move.

3. The weaving loom as claimed in claim 1, wherein said machine frame includes a fixed upper race rail with a bottom surface, and a fixed lower race rail with a top surface, each of said bottom surface of said upper race rail and said top surface of said lower race rail being formed with an open-ended longitudinal guide slot and being provided with two fixed longitudinal plates, which extend respectively into two side portions of said guide slot to locate said shuttle between one of said upper and lower race rails and said longitudinal plates, thereby confining said shuttle within said guide slot, said shuttle being attracted onto said magnet unit during movement of said shuttle within said upper and lower race rails.

4. The weaving loom as claimed in claim 1, wherein said beating mechanism includes a reed assembly consisting of a row of reed dents, and a swinging device, which is connected to said reed dents for swinging said reed assembly, each of said reed dents having a horizontal portion so as to form a flat shuttle guide-way on top surfaces of said horizontal portions of said reed dents, thereby guiding the weft into said shed, said machine frame being provided with an elongated wedge-shaped divider, which is fixed thereon near said driving wheel and which has an abutment end that is adjacent to said shuttle guide-way, and a wedge-shaped end that is away from said shuttle guide-way and that is adjacent to said driving wheel, said divider having a flat horizontal top surface that is flush with said shuttle guide-way so that said shuttle moves from said driving wheel along said driving belt to said wedge-shaped end of said divider, thereby separating said shuttle and said magnet unit at said wedge-shaped end, said shuttle moving from said wedge-shaped end to said top surface of said divider and said shuttle guide-way on said reed assembly.

5. The weaving loom as claimed in claim 1, wherein said magnet unit includes a plurality of magnets, and an elongated and corrugated longitudinal plate, which is fixed on said driving belt so as to define a plurality of magnet receiving spaces between said corrugated plate and said driving belt, thereby receiving said magnets fittingly within said magnet receiving spaces, respectively.

6. The weaving loom as claimed in claim 5, wherein said inside surface of said driving belt is formed with two longitudinal rows of teeth, between which said corrugated longitudinal plate is fixed on said driving belt, each of said driving wheel and said driven wheel being constructed as a spur gear, which has an outer periphery that is formed with teeth for engaging said teeth of said driving belt.

7. The weaving loom as claimed in claim 6, wherein said driving belt has at least one longitudinal row of guide holes formed therethrough, each of said driving wheel and said driven wheel having an outer periphery, which is formed with a plurality of fixed short tongues that extend radially and outwardly therefrom to engage said guide holes in said driving belt.

8. The weaving loom as claimed in claim 1, wherein said driving wheel includes a rotating shaft, and two spur gears that are sleeved fixedly on said rotating shaft and that are spaced apart from each other, thereby defining therebetween a space, within which the shuttle and the magnet unit move.

* * * * *